United States Patent [19]

Lejnar

[11] Patent Number: 4,883,086

[45] Date of Patent: Nov. 28, 1989

[54] ASPIRATION CHEMICAL SUPPLY APPARATUS AND METHOD

[76] Inventor: Emil A. Lejnar, 201 S. Lake Dr., Lehigh Acres, Fla. 33936

[21] Appl. No.: 263,201

[22] Filed: Oct. 26, 1988

[51] Int. Cl.[4] ..... B01F 5/04

[52] U.S. Cl. ..... 137/399; 137/893; 222/66; 239/318

[58] Field of Search ..... 137/399, 893; 222/66; 239/318

[56] References Cited

U.S. PATENT DOCUMENTS

| | | | |
|---|---|---|---|
| 1,397,523 | 11/1921 | Jerdone, Jr. . | |
| 1,512,384 | 10/1924 | Whittington . | |
| 1,664,803 | 4/1928 | Agassiz . | |
| 2,006,532 | 7/1935 | Bagley | 222/66 |
| 2,058,901 | 10/1936 | McPherson . | |
| 2,141,638 | 12/1938 | Bean | 222/66 |
| 2,724,583 | 11/1955 | Targosh et al. . | |
| 3,491,948 | 1/1970 | Alexander | 239/304 X |
| 3,613,997 | 10/1971 | Thompson | 137/893 X |
| 3,669,357 | 6/1972 | Overbey . | |
| 4,355,739 | 10/1982 | Vierkotter | 239/305 X |
| 4,651,930 | 3/1987 | Magaha, Jr. . | |

FOREIGN PATENT DOCUMENTS

| | | | |
|---|---|---|---|
| 688395 | 6/1964 | Canada | 239/318 |

*Primary Examiner*—Robert G. Nilson

*Attorney, Agent, or Firm*—Mason, Fenwick & Lawrence

[57] ABSTRACT

An apparatus for distributing liquid fertilizers, pesticides and other chemicals by aspiration into irrigation conduits. Liquid passing through a conduit attached to a storage vessel syphons the chemicals out of the storage vessel and into a liquid distribution system. An anti-backflow check valve is provided to prevent liquid from entering the supply container when liquid flow is stopped in a liquid distribution system. A float-controlled valve is also provided which closes when the liquid level in the supply vessel reaches a predetermined level in order to prevent air from entering the system. The amount of chemical aspirated into the liquid distribution system is controlled by a valve. The apparatus is easily assembled and disassembled for cleaning or repair, and can be connected to existing liquid distribution systems. Larger or remote reservoirs can be incorporated depending on the application.

19 Claims, 5 Drawing Sheets

ASPIRATION CHEMICAL SUPPLY APPARATUS AND METHOD

FIELD OF THE INVENTION

The present invention generally relates to a method and apparatus for distributing liquid fertilizers, pesticides and other agricultural chemicals. In particular, the present invention is concerned with distributing lawn chemicals in lawn irrigation systems which require the frequent application of small quantities of fertilizers and/or pesticides to large areas.

BACKGROUND OF THE INVENTION

Commercial lawn care companies usually distribute lawn care and agricultural chemicals when the sun is shining and do not generally concern themselves if a rain storm occurs too soon after the chemicals have been applied to allow the chemicals to be absorbed by the soil. In addition, since the chemicals supplied by commercial distributors must last a considerable period of time until the next visit, very concentrated dosages of chemicals are used. This may be unhealthy for lawns, not to mentions humans and pets.

Spreading too much fertilizer or pesticide onto lawns and crops may also result in run-off into ponds, rivers and oceans. Marine biologists have suggested a possible link between decreasing crab and oyster harvests from the Chesapeake Bay and fertilizer run-off from farms. If farmers could control the timing, as well as the amount, of fertilizer they spread on their crops, less run-off may result.

Common methods of applying pesticides and fertilizers include the use of push-type granular spreaders or the spreading of dry chemicals by hand. Hand-held sprayers which attach to garden hoses are also commonly used to spread chemicals; one such sprayer is described in U.S. Pat. No. 2,724,583 (Targosh et al) which uses a venturi near the nozzle of a hose to create a suction to draw chemicals from an attached container. All of these methods still require the user to stand outside in the elements with the attendant exposure to the chemicals being applied. The prior art spreading methods are also very time-consuming, and it is difficult to judge the precise quantities of chemicals being spread over a given area in a given period of time.

Furthermore, hand-held sprayers require pulling a hose around the area to be treated, and also need frequent refilling since only a small amount of chemicals can fit into the hand-held reservoirs. In addition, in some prior art hand-held sprayers, a venturi is located near or in the spray nozzle. This arrangement substantially reduces flow of liquid out of the sprayer, thus slowing the application process.

Large commercial growers may use built-in commercialtype injectors placed on the pressure side of a pump forming part of a liquid distribution system. However, these systems are expensive and tend to reduce the overall flow of liquid through the distribution system.

One solution to these problems is proposed in U.S. Pat. No. 3,669,357 (Overbey) which discloses an injection and distribution unit for a lawn sprinkler system. The unit includes a reservoir, transfer tube and connector which injects liquid fertilizers and pesticides into a lawn sprinkler system. Fluid flowing through the main pipe of the irrigation system creates a suction zone in a transfer tube attached to a chemical reservoir. However, there are no means to control backflow into this reservoir in order to prevent undesirable dilution of the chemical stored in the reservoir, nor is there a means available to control flow out of the reservoir. Once all of the liquid in the reservoir has been exhausted, air will be sucked into the liquid distribution system pump causing liquid flow to slow or stop until the pump is reprimed.

There is thus a need for an agricultural chemical distribution system which can apply the appropriate amount of chemicals over large areas at the appropriate time, while requiring only minimal human contact with the chemicals to be applied, and minimal effort to control the amount and timing of the supply. In addition, there is a need for a chemical distribution system which may be placed in line with a pump for a liquid distribution system that will not affect the performance of the pump by allowing air into the pump or allow backflow from the liquid distribution system. The present invention is directed toward filling these needs.

SUMMARY OF THE INVENTION

An improved method and apparatus for distributing liquid fertilizers, pesticides and other agricultural chemicals is described herein. The apparatus is intended for installation between a pump inlet for a liquid distribution system and a conduit connected to a supply of water. In the preferred embodiment, a check valve is located in the conduit between the apparatus and the supply of water. A motor for running the pump is connected inline with a timer which can automatically control distribution time. A zone selector follows the output of the pump to distribute liquid to different portions of a lawn.

The heart of the chemical supply apparatus is a unitary housing which connects into a conduit leading to a distribution system pump. The housing is attached with detachable and disposable couplings which are screwed into the ends of a conduit passing through the housing. A venturi is located in the housing conduit connected in line with the liquid distribution system conduit. When liquid flows through the venturi, it creates a suction in intersecting conduits passing through the housing. The suction draws chemicals from a reservoir through a tube attached to the housing conduits. The reservoir may be attached to the housing or located away from the housing.

A control valve is built into the housing to regulate flow of liquid through the housing conduits and into the liquid distribution system. The control valve is made by inserting a cylinder into a conduit passing through the housing. Liquid may flow into a cavity in the bottom of the cylinder and out through an orifice in the side of the cavity, provided the orifice is aligned with an intersecting conduit leading to the venturi. A knob is attached to a shaft protruding from the valve cylinder to allow manual rotation of the cylinder in the housing. This alters the alignment of the cylinder orifice with the conduit leading to the venturi, and thereby regulates flow through the housing. This valve may also be referred to as a moon-phase flow controller due to the shapes formed by the partial alignment of the cylinder orifice with the intersecting conduit.

A lid protrudes from the housing to enable direct attachment of a reservoir. A hole is provided in the lid for filling the reservoir without removing it from the housing. A cap screws over the hole to prevent foreign matter from entering the reservoir. A vent is placed in the cap to prevent a vacuum from forming in the reservoir as chemicals are withdrawn. The reservoir does not need to be attached directly to the housing, and may be located at a distance from the housing during use. This allows for a variety of reservoir sizes and shapes, as well as for the use of a series of reservoirs connected by the appropriate tubing and valves.

The conduit containing the control valve is connected to the tube leading into the reservoir. A unidirectional anti-backflow valve is located inside of the tube near the connection of the tube to the housing. The valve is made from a needle which is pressed against a valve seat molded into the inside of the tube. A spring is attached to the top of the valve needle, and the other end of the spring is attached to a spring stop located in the tube between the valve seat and the housing connection. The spring forces the needle against the valve seat, and prevents liquid from flowing from the housing, down the tube and into the reservoir. When the pump draws liquid through the venturi, and the orifice in the control valve cylinder is aligned with the conduit leading to the venturi, liquid in the reservoir forces the needle against the spring to allow flow of liquid into the housing from the tube.

A float shut-off valve is attached near the bottom of the tube. A spring stop on the outer circumference of the tube is attached to a spring which, in turn, is attached to the top of a float encircling the tube. The bottom of the tube is sealed. Radiating from the lower circumference of the tube is a valve seat which conforms to the bottom of the float. Intake holes are located above the valve seat to allow liquid flow from the reservoir into the tube. The spring forces the float bottom against the valve seat, and covers the intake holes. When sufficient liquid is in the reservoir to lift the float above the intake holes, liquid will flow from the reservoir into the tube. When the liquid level falls to the level of the intake holes, the float will cover the intake holes and prevent air from entering the tube.

Hollow conduit inserts may be used in the zone conduits to adjust for the insertion of the chemical supply apparatus into a liquid distribution system. To use the inserts, the zone conduits are cut and the inserts are attached between the cut ends.

The preferred embodiment of the present invention allows the apparatus to be used with a liquid distribution system controlled by a timer and provided with a zone selector. A pump, located upstream from the apparatus, draws liquid through a venturi in the housing which evacuates conduits in the housing and thereby creates suction in a tube leading from the conduits into a reservoir. By use of a control valve in the housing, the flow of liquid from the reservoir and through the housing may be controlled. Valves on the tube leading from the reservoir to the housing will prevent backflow from the liquid distribution system into the reservoir, as well as prevent air above the liquid in the reservoir from entering the pump.

It is a primary object of the present invention to provide a low-cost apparatus that will accurately dispense the appropriate amount of chemical at the appropriate time to large areas with minimal effort and minimal human contact with chemicals.

It is another object of the present invention to provide an apparatus which is easily assembled and disassembled for cleaning, repair or replacement of worn parts.

It is a further object of the present invention to provide a means for easy connection and disconnection of the apparatus to existing liquid distribution systems.

It is still another object of the present invention to provide a device to accurately and precisely control the timing and amount of chemical supplied to the liquid distribution system.

It is a further object of the present invention to prevent undesired dilution of the chemicals to be supplied to the liquid distribution system.

It is still a further object of the present invention to prevent air from being sucked into the liquid distribution system pump which may cause liquid flow to slow or stop.

Another object of the present invention is to provide a device which is usable for a wide range of applications.

A further object of the present invention is to provide a compact device which is simple and easy to use.

In addition to the foregoing, the present invention has few moving parts, requires minimal attention on the part of the user, is low in cost and will provide accurate and reliable distribution of chemicals over large or small areas.

These and other objects and advantages will become more apparent from the following preferred embodiments and the accompanying illustrative but not restrictive drawings.

DETAILED DESCRIPTION OF THE PREFERRED EMBODIMENTS

Figure 1:
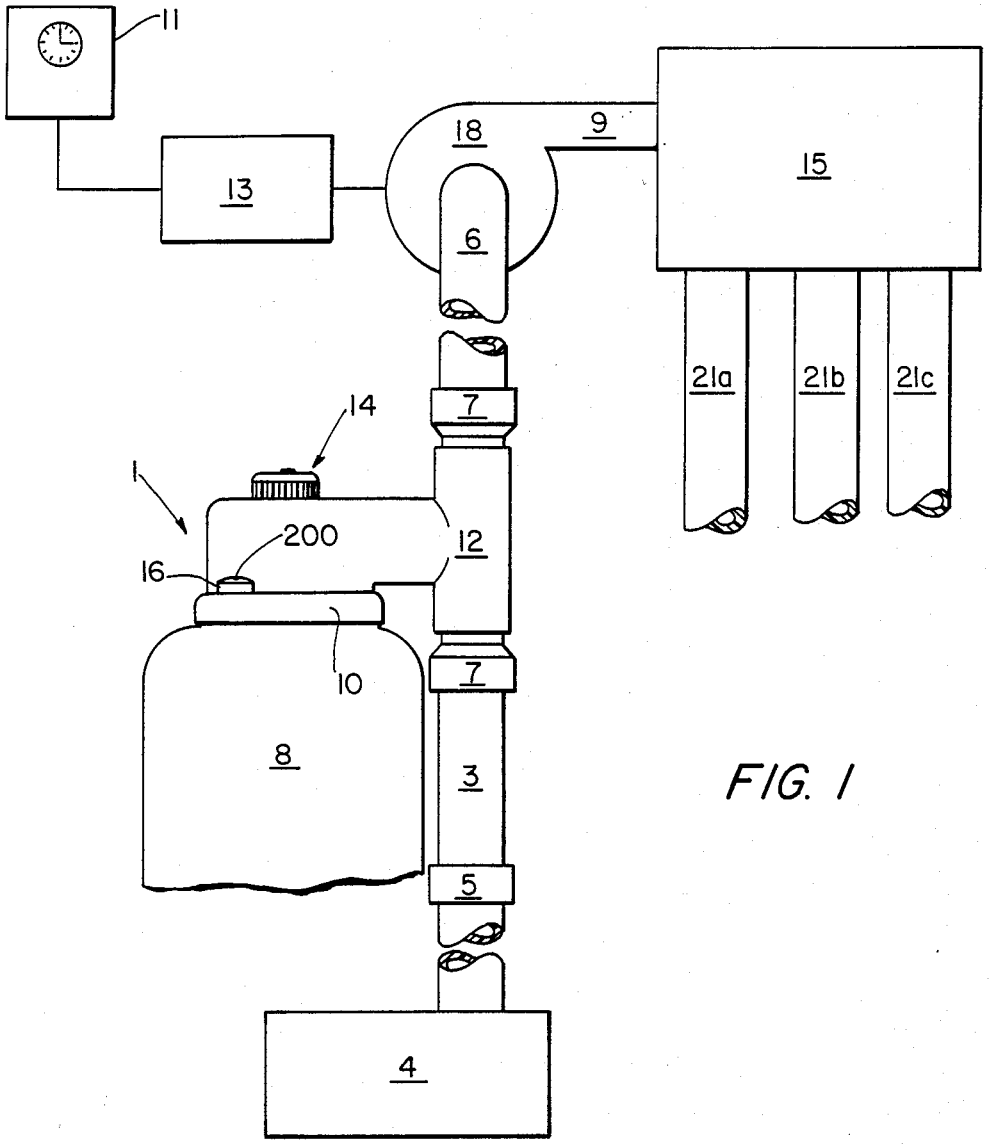
FIG. 1 is a side plan view of a preferred embodiment of the present invention in conjunction with a reservoir connected in line with a liquid distribution system pipe.
Figure 3:
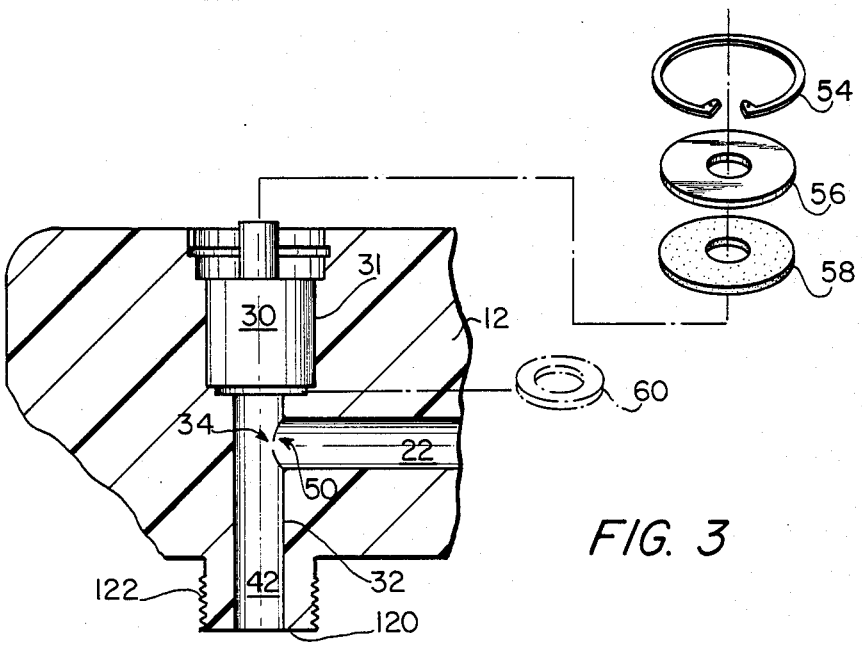
FIG. 3 is a partially exploded view of the liquid control assembly of the embodiment of FIG. 1.

In accordance with the teachings of the present invention, there is disclosed herein a preferred embodiment which is shown generally in FIG. 1. The chemical supply apparatus, which is generally designated as 1, is used in connection with a liquid distribution system 2 which includes hollow conduits 3, 6, 9, having input and output ends. The housing 12 is connected with couplings 7 between the output end of conduit 3 and input end of conduit 6. A source of water 4 provides liquid to the distribution system 2 through the input end of conduit 3. When timer 11 activates motor 13, pump 18 draws liquid up conduit 3, through housing 12 and into conduit 6. A check valve 5 in conduit 3 prevents backflow towards source 4 when pump 18 is inactive.

Liquid flowing through housing 12 draws chemicals stored in reservoir 8 through the housing 12 and into conduit 6. Pump 18 thoroughly mixes these chemicals with the liquid from conduit 6 and forces the mixture through conduit 9 towards conventional zone selector 15. Depending on the setting of the zone selector 15, liquid will flow from conduit 9, through zone selector 15, and into conduit 21*a*, 21*b* or 21*c*.

At the heart of the invention is a housing 12 made from formed plastic or PVC which is cut and drilled to the desired shape. With further reference to FIGS. 2 through 5, the housing 12 contains conduits 20, 22 and 24, described below, to allow liquid to flow from the reservoir 8, through the housing 12, and into the liquid distribution system 2. A control valve 14 is situated in the housing 12 to regulate flow of liquid from reservoir 8. The valve is fabricated by inserting a cylinder 30, with a top section 31 of wider outer diameter than the outer diameter of the bottom section 32, into a conduit 20 passing through the housing 12. The valve conduit 20 in housing 12 has inner diameters and dimensions substantially conforming to the outer dimensions of the cylinder 30. A snug fit is preferred to avoid leakage of air or liquid.

The cylinder 30 is held in place by a circlip 54 placed on top of the cylinder 31. The circlip 54 fits into a lip 52 at the top of the valve conduit 20. Plastic washer 56 and rubber washer 58 can be placed between the circlip 54 and the cylinder top 31 to form a tighter seal while enabling easier rotation of the cylinder 30 in the valve conduit 20. The valve conduit 20 is wider at the top to enable insertion of the narrow bottom 32 of the cylinder 30 first followed by the wider cylinder top 31. The narrower cylinder bottom section 32, when inserted into the valve conduit 20, projects towards an inlet 120 on the bottom of the main housing. The inlet 120 is extended out from the bottom of the main housing 12 to form a threaded protuberance 122 for attachment to a female threaded attachment assembly 102 on top of tube 100.

The valve conduit 20 has an orifice 50 on the side of its narrower inner diameter section created by an intersecting conduit 22 in the housing 12. The bottom section 32 of valve cylinder 30 is partially hollowed out from its bottom upwards towards the top of the control valve cylinder to form a cavity 42. An orifice 34 is located in the side of the cylinder lower section 32 near, or at the top of, the hollowed out cavity. After inserting the valve cylinder 30 into the valve conduit 20, the orifice 34 on the valve cylinder 30 is located at the same distance from the top of the housing 12 as the orifice 50 on the side of the valve conduit 20 is located from the top of the housing 12. By rotating the cylinder 30 in the conduit 20, it is possible to partially or completely align orifice 34 with orifice 50. In this mode, liquid may enter conduit 20 at inlet 120, and flow into the cavity 42 in the cylinder bottom section 32. Liquid in cavity 42 may flow out of orifice 34 in the cylinder lower section 31 through orifice 50 on the side of the conduit 20 and into the intersecting conduit 22.

The control valve 14 could also be called a moon phase flow controller since the variable opening shapes created by the partially or completely aligned orifices 34 and 50 resemble the phases of the moon. The valve cylinder 30 has been machined from a graphite impregnated plastic made by Polymer Company, Nylatron GS ROD #190-7, but it can also be fabricated in pieces from a wide variety of other materials. For example, it is possible to form the valve cylinder 30 from an impervious cylinder which has a piece of narrower outer diameter tubing attached to its bottom. An orifice may be cut in the side of the tubing to duplicate the cylinder 30, lower section 31 and orifice 34.

A shaft 44 projects from the top of the cylinder upper section 31 and rises above the housing 12. A knob 36 is attached with a screw 38 to the top of the shaft 44, and enables rotation of the cylinder 30 in the conduit 20. In addition, the shaft 44 may be used to easily pull the cylinder 30 out of the valve conduit 20. An optional rubber O-ring 60 may be used at the junction of the cylinder upper section 31 and cylinder lower section 32 to create a better seal with the valve conduit 20. A lubricant may also be used on the outer surface of the cylinder 30 for easier rotation.

Figure 5:
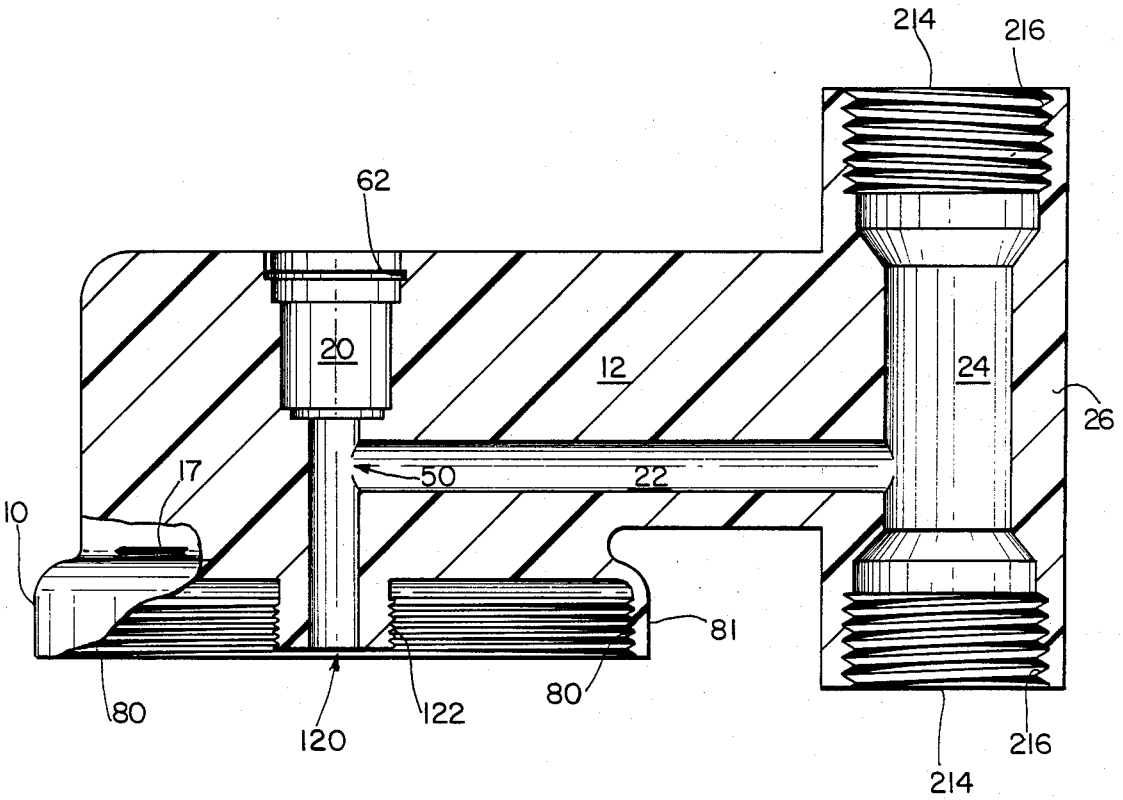
FIG. 5 is a cross-sectional view of the housing of the embodiment of FIG. 1.
Figure 9:
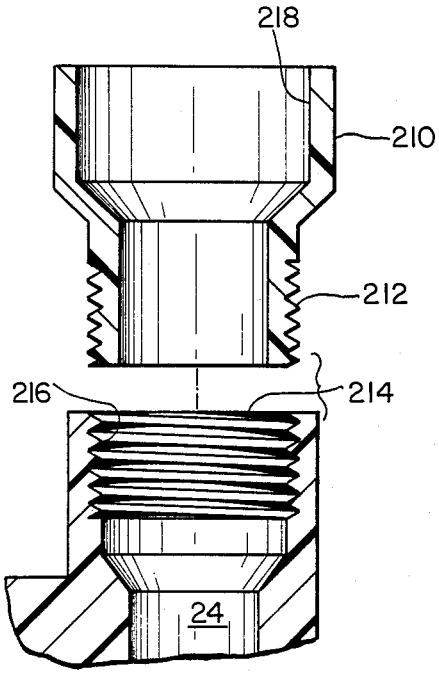
FIG. 9 is a cross-sectional view of a coupling to be attached to the embodiment of FIG. 1.

With reference to FIGS. 5 and 9, intersecting conduit 22 leads from the valve conduit 20 to the suction conduit 24 that passes completely through the housing 12. At either end of the suction conduit 24, the housing 12 is extended to provide threaded protuberances 214 for connection to female or male threaded couplings 7. One coupling 7 is attached to the output of conduit 3 leading from water source 4, and another is attached to the input end of conduit 6 leading to the pump 18. The couplings 7 can be permanently fixed to both ends of the conduits 3 and 6 to enable quick and easy attachment and detachment of the chemical supply apparatus 1.

In one embodiment as shown in FIGS. 1 and 5, the couplings 7 may be glued onto the conduits 3 and 6, after screwing threads 212 into threads 216 in protuberances 214 on the suction conduit 24. Unthreaded ends 210 have interior sections 218 which fit over the outlet of conduit 3 or inlet of conduit 6. In order to remove the chemical supply apparatus 1 from the distribution system 2, the conduits 3 and 6 are cut on either side of the couplings 7. The couplings 7 are then unscrewed from the suction conduit 24 and discarded. New couplings 7 are then screwed into the suction conduit 24, and the chemical supply apparatus 1 reattached by gluing the ends 210 onto conduits 3 and 6. A suitable glue for sealing the couplings 7 to PVC piping is Uniweld 2800 Cement for PVC.

Other conventional plumbing connecting assemblies may also be used to provide for quick attachment and disconnection of the chemical supply apparatus 1 to a liquid distribution system 2. Separate attachment assemblies may not be necessary if the liquid distribution system 2 already has pipes or tubing with ends which are suitably shaped to seal to the extensions 214 on the suction conduit 24.

The inner diameter of the suction conduit 24 becomes narrower between its opposite ends creating a venturi 26. Liquid flowing through the suction conduit 24 passes from a larger inner diameter section to a narrower inner diameter section and then to larger inner diameter section. The intersecting conduit 22 meets the suction conduit 24 in the area of narrowest inner diameter. Liquid flowing through the suction conduit 24 creates a suction in the intersecting conduit 22 due to a venturi effect.

With reference to FIGS. 2 through 6, an elongated tube 100 is attached to inlet 120 leading from conduit 20. In a preferred embodiment, the tube 100 has a threaded female fitting 102 which can screw on to the threaded protuberance 122 surrounding inlet 120. In this way, it is possible to easily detach and attach different lengths of tubes to the housing. However, the apparatus 1 will also work if the tube 100 is permanently attached to inlet 120 or some other method of attachment is used. For example, tube 100 may be inserted into the valve conduit 20, rather than over protuberance 122 at inlet 121.

The tube 100 projects into a reservoir 8 containing a chemical supply. The reservoir 8 can be directly attached to the housing 12 or it can be detached from the housing 12 and placed in a remote location. The reservoir 8 may be attached to the housing 12 by screwing threaded top 80 onto the threaded inner perimeter 81 of a circular lid 10 projecting from the housing 12. In the preferred embodiment, inlet 120 is located inside perimeter 81 of lid 10 so that the tube 100 will project into the interior of an attached reservoir 8.

In a preferred embodiment, a clear plastic or glass container is used as the reservoir 8. However, other materials, such as metal, may be used depending upon the chemicals to be distributed. The reservoir 8 may also clip on to the housing 12, or horizontal grooves and vertical slots may be placed into the lid inner perimeter 81 so that the top of a reservoir 8, with suitable protuberances, will fit into the vertical slots on the lid. A ¼ or ½ rotation of the reservoir 8 will slide the protuberances radiating from the reservoir top into the horizontal grooves, and result in a firm attachment between the reservoir 8 and the lid 10.

Figure 8:
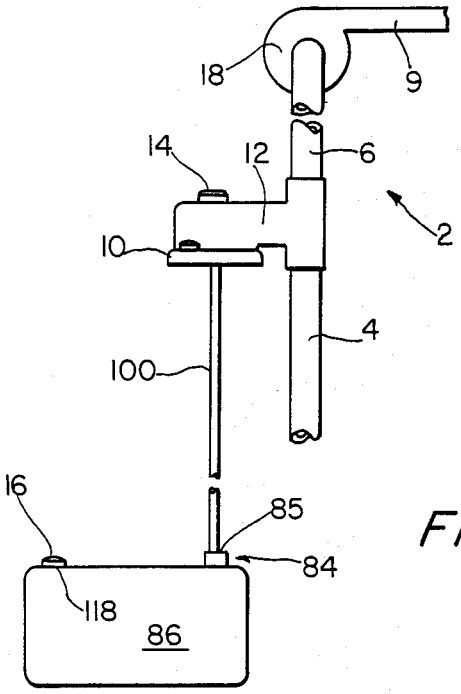
FIG. 8 is a schematic view of an alternative embodiment of the present invention in conjunction with a remote reservoir and connected in line with a liquid distribution system pipe.

With reference to FIG. 8, if detached reservoir 86 is to be used, the tube 100 attached to inlet 120 must be flexible and long enough to reach the bottom of the remote reservoir 86. The detached reservoir 86 can be of any size or shape. Note that the lid 10 is not necessary when using the remove reservoir. In a preferred embodiment, the tube 100 attached to the inlet 120 projects through a circular orifice 85 in the lid 84 on the top of reservoir 86.

Figure 10:
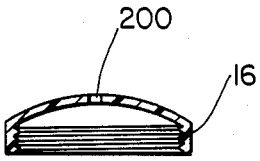
FIG. 10 is a cross-sectional view of a vented cap which may be used in the embodiments of FIGS. 1 and 8.

With reference to FIGS. 1, 8 and 10, both the attached reservoir 8 and detached reservoir 86 require vents 117 and 118 to enable liquid to be sucked out while avoiding the creation of a vacuum in the reservoir 8 and 86. When reservoir 8 is attached to the lid 10, an orifice 117 on the housing lid enables air to enter the reservoir 8 as liquid is removed from the reservoir 8. This orifice 117 also acts as an inlet for refilling the reservoir 8 without detaching the reservoir 8 from the housing 12. A ca 16 with vent 200 may be screwed over orifice 17 to prevent foreign matter from entering reservoir 8. In the detached reservoir 86, a vent 118 may be placed anywhere on the upper part of the container or it may also be placed on the lid 84. Multiple detached reservoirs 86 (not shown) may also be used and connected with the appropriate valves and tubing. In this way, different chemicals may be applied by merely turning the appropriate valve.

Figure 2:
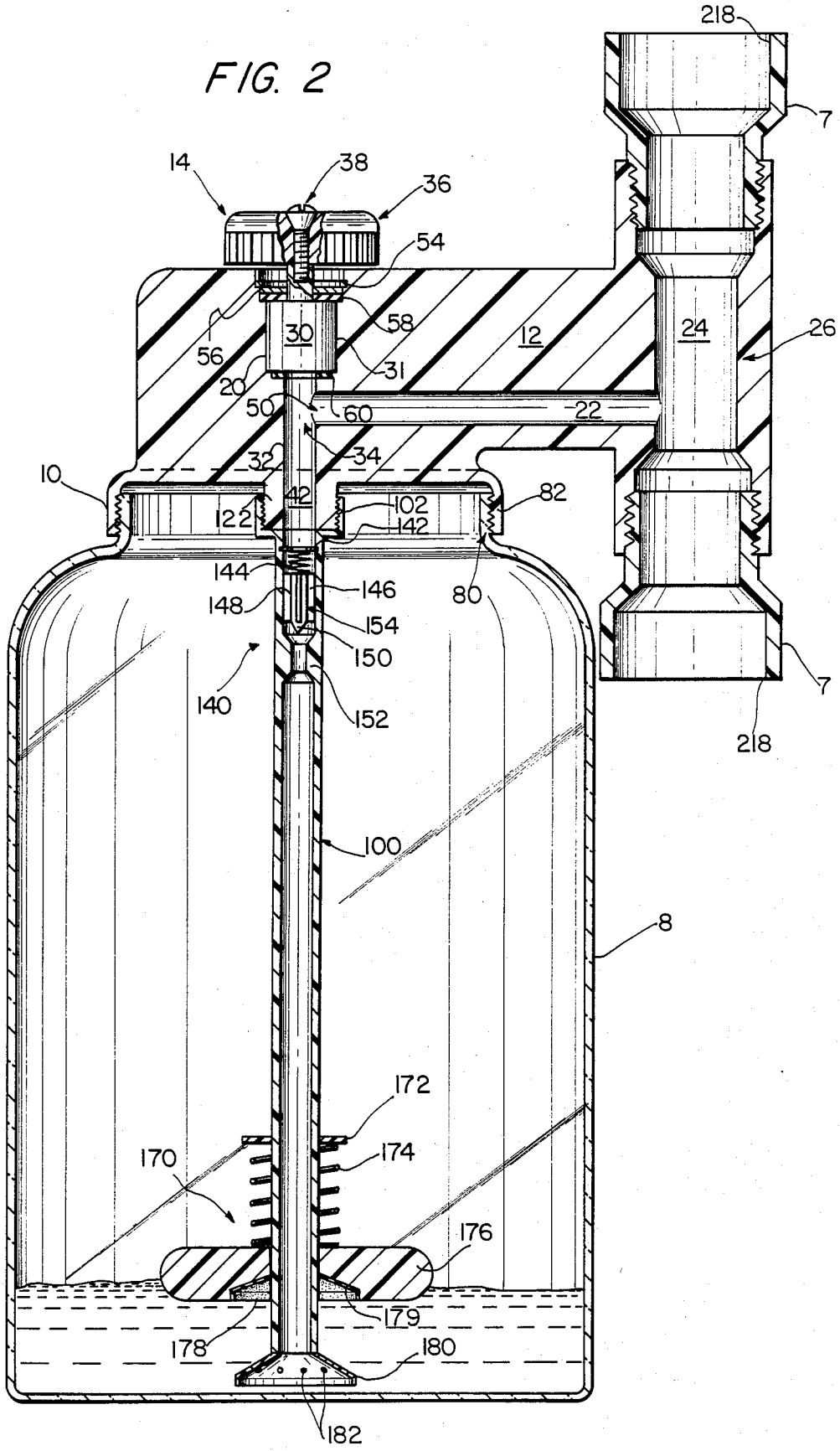
FIG. 2 is a cross-sectional view of the reservoir portion of the embodiment of FIG. 1.

With reference to FIGS. 1 and 2, if there is not a check valve 5 leading to the pump 18, a float valve 170 in the chemical supply apparatus 1 will prevent air from entering the liquid distribution system 2. In addition, the control valve 14 may be turned off to prevent chemicals from leaving the reservoir 8 when the pump 18 is not operating. This may be done manually or a suitable control may be used to automatically close off the apparatus 1 when the pump 18 is not operating. Another alternative is to install a check valve 5 between the apparatus 1 and the source of water 4 if one is not already installed.

The tube 100, attached to inlet 120, can be made out of Lucite, brass or any other suitable material. In practice, Lucite does not appear to be effected by the lawn chemicals stored in a reservoir with it.

Figure 4:
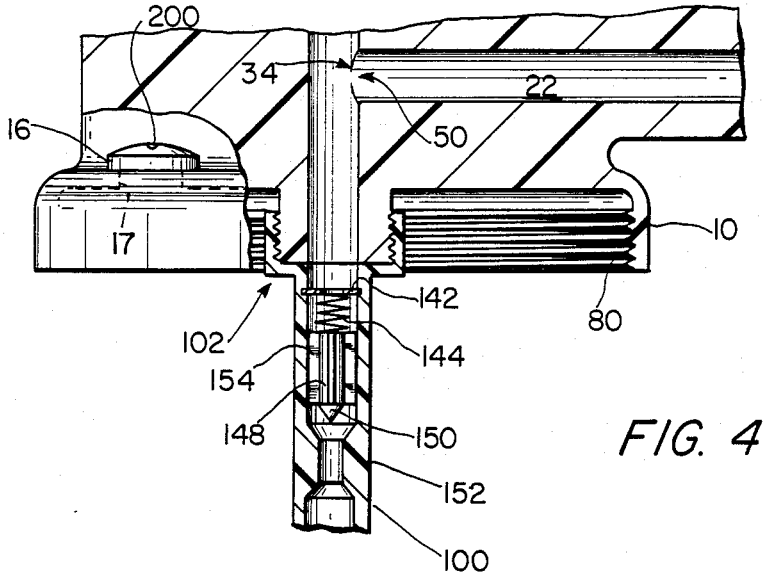
FIG. 4 is a cross-sectional view of the backflow shut-off valve and the connection of the transfer assembly to the housing of the embodiment of FIG. 1.
Figure 6:
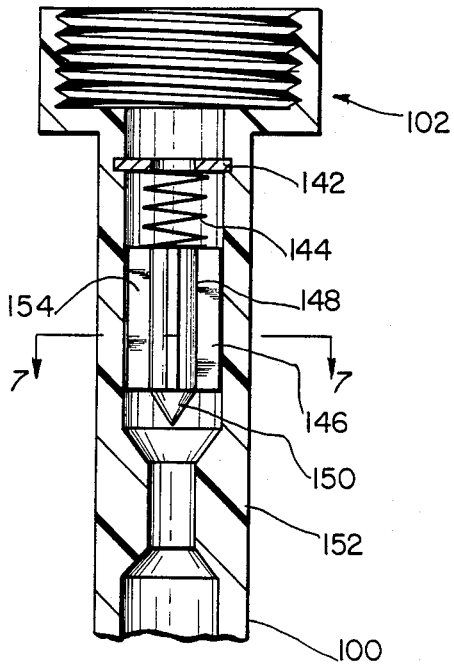
FIG. 6 is an isolated view of the backflow shut-off valve of FIG. 4.

With reference to FIGS. 4 and 6, a backflow prevention valve 146 is provided in the interior of tube 100 near the connection to inlet 120. The purpose of the valve 146 is to prevent water from flowing back into the reservoir 8 from the liquid distribution system 2 when the pump 18 is turned off.

A valve seat 152 is located inside of the tube 100 near the connection to inlet 120. The valve seat 152 can be molded into the tube 100 to create an area of narrower inner diameter than the rest of the tube's 100 inner diameter. A needle 146 is placed inside of the tube 100, above the valve seat 152. In a preferred embodiment, the needle 146 has a cylindrical top 148 and a conical bottom 150. The conical bottom 150 substantially conforms to the shape of the valve seat 152. A rubber coating may be placed on the conical bottom 150 to create a better seal with the valve seat 152. A spring 144 is attached to the cylindrical top 148 of the needle 146, and the other end of the spring 144 is attached to a spring stop 142 molded into the interior of tube 100 above the valve seat 152. The spring 144 and gravity force the bottom 150 into the seat 152, thereby blocking the flow of liquid or air down the tube 100. When the needle 146 is dislodged from the seat 152, liquid may flow around the needle 146 and up the tube 100.

Figure 7:
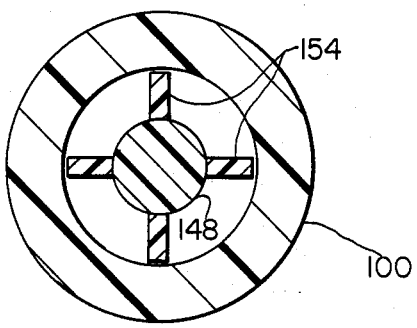
FIG. 7 is a view taken along lines 7—7 of FIG. 6.

With reference to FIG. 7, protuberances 154 may project from the cylindrical top 148 to the inner walls of the tube 100 in order to align the needle 146 properly in the valve seat 152, while still allowing passage of liquid around the needle 146 in the tube.

With reference to FIG. 2, it should be readily apparent that when orifice 34 is partially or completely aligned with orifice 50, liquid may flow up the tube 100 attached to inlet 120 into the valve conduit 20, through the cavity 42 in the lower section 32 of the cylinder 30, and then flow out through orifice 34 past orifice 50 and into intersecting conduit 22. Liquid may then flow through the intersecting conduit 22 to the suction conduit 24 and, from there, into the liquid distribution system pump 18.

Liquid flowing through the suction conduit 24 creates a venturi effect which sucks liquid through the intersecting conduit 22 and out of the valve conduit 20. With this arrangement, a suction created by the venturi 26 in the suction conduit 24 may be transferred to the bottom of the tube 100 attached to inlet 120.

With reference to FIG. 2, the lower portion of the tube 100 attached to the inlet 120 is situated close to or at the bottom of reservoir 8. The bottom of the tube 100 is sealed. Protruding radially from the bottom circumference of the tube 100 is a lip 180. Immediately above the lip 180 on the bottom of the tube 100 are located holes 182 for permitting flow of liquid from the interior of the reservoir 8 into the tube 100. Located above the intake holes 182 is a spring-stop 172 molded as part of, or attached onto, the outside of the tube 100. The spring-stop 172 is connected to a spring 174 which, in turn, is attached to the top of a float 176 encircling the tube 100. The spring 174 forces the float 176 downward towards the conical lip 180 so that the intake holes 182 are blocked by the float 176. The bottom 178 of the float projects inwardly to substantially conform to the shape of the protruding lip 180 on the tube 100 so that the lip 180 acts as a valve seat for the float 176. When a sufficient quantity of liquid is placed into the reservoir 8, the float 176 will push upwards against the spring 174 and uncover the intake holes 182, allowing liquid from the reservoir 8 to enter the tube 100. The float may be made of a resilient material such as rubber or may be made of a hard material such as plastic with the interior surface 178 being covered with a rubber liner 179.

As the liquid level falls in the reservoir 8, the float 176 will be pushed over the intake holes 182, and against the lip 180 on the tube 100, preventing liquid from leaving the reservoir 8. In this fashion, air above the surface of the liquid in the reservoir 8 is prevented from entering the tube 100. It is important to avoid intake of air into the tube 100 so the pump 18 may continue to pump water when the reservoir 8 runs out of chemicals. This also avoids the need for repriming the pump 18 once air has entered it. If air were to enter the pump 18 through the intake holes 182 on the bottom of tube 100, less water could be pumped from the water source 4, or the flow of water from the source 4 through the liquid distribution system 2 may be stopped entirely. This depends on the inner diameter of the suction conduit 24 and the intersecting conduit 22, as well as on the power of the pump 18.

The float 176 on the outside of the tube 100 can be made of any material which is not susceptible to attack from the chemicals stored in the reservoir 8. For example, the float can be formed from hollow plastic, hollow metal or any other suitable material.

With all of the previously described components, a preferred embodiment operates as follows: Water flowing from the source 4, due to the action of the pump 18 on the other side of the suction conduit 24, is drawn through the suction conduit 24 creating a venturi effect which evacuates the intersecting conduit 22. If the orifice 34 is aligned with orifice 50, suction will be applied to the interior of the tube 100. If a sufficient quantity of chemicals are located inside the reservoir 8 to lift the float 176 above the intake holes 182, chemicals in the reservoir 8 will be sucked into the intake holes 182, up the tube 100, and into the valve conduit 20. Subsequently, the chemicals will be sucked into the intersecting conduit 22, then into the suction conduit 24, and onto the pump 18. The chemicals will be completely mixed with water from the source 4 in the pump 18. A timer 11, attached to the pump 18, can be used to determine when chemicals will be distributed. The control valve 14 may be rotated to close off the reservoir 8 and permit only water, rather than a mixture of chemicals and water, into the distribution system 2.

The apparatus 1 described herein, may be used with a timer 11 and a zone selector 15 to control both the timing and location of chemical distribution. In systems with a zone selector 15, installation of the apparatus 1 may require extension of the pipes 21*a*, 21*b* and 21*c* leading from the zone selector 15.

Figure 11:
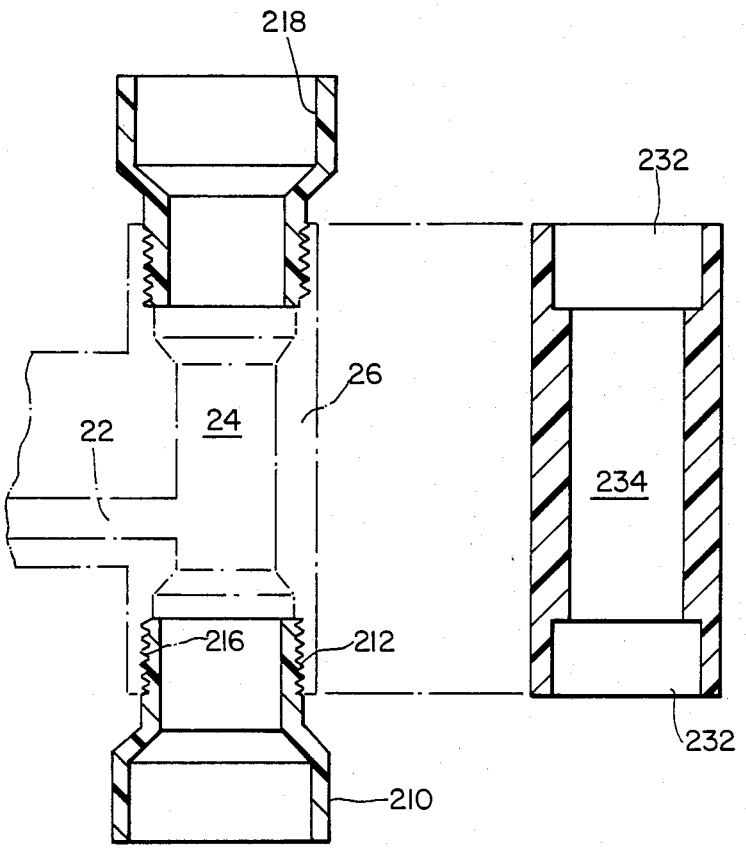
FIG. 11 is a cross-sectional view of an optional insert to aid in installation of the embodiments of FIG. 1 or FIG. 8.

With reference to FIG. 11, inserts 230, of the same interior length 234 as the suction conduit 24, can be used to adjust the liquid distribution system 2 to the apparatus 1. These inserts 230 may be detachable or permanently installed by inserting the cut ends of conduits 21*a*, 21*b* and 21*c* into the couplings 232 on inserts 230.

From the above, it is apparent that many modifications and variations of the present invention are possible in light of the above teachings. It is therefore to be understood that, within the scope of the appended claims, the invention may be practiced otherwise than as specifically described.

What is claimed is:

1. A liquid chemical supply device for use with a liquid distribution system comprising:

storing means for storing chemical supply;

transfer means attached to said storing means for transferring chemicals out of said storing means;

control means attached to said transfer means for controlling liquid flow from said transfer means;

connecting means adjacent to said control means for carrying chemicals from said control means to the liquid distribution system;

attaching means on said connecting means for attaching said connecting means to the liquid distribution system;

suction means in said attaching means for creating suction in said connecting means and transfer means;

prevention means in said transfer means for preventing liquid in the distribution system from flowing into said storing means;

stopping means on said transfer means for automatically stopping liquid flow from said storing means into said transfer means when chemical supply in said storing means reaches a predetermined level;

wherein said storing means comprises a closed container with a top and an opposed bottom, said closed container having an opening defined by a lid at said top of said container, said container defining a reservoir interior for holding a supply of liquid chemicals;

wherein said transfer means comprises an elongated hollow tube having one end attached to said control means and the other end terminating at the bottom of said storing means; and wherein said other end of said tube includes a closure portion closing off said other end from the passage of said chemical supply, and at least one opening defined along the cylindrical periphery of tube near said other end, and wherein said stopping means comprises a float means movably mounted to said tube, and an elongated spring means fixedly mounted to said tube, said spring for normally urging said float means in a first direction for blocking fluid flow through said at least one opening, said float means operative in a second direction under the urging of said liquid for opening said at least one opening to fluid flow.

2. The device according to claim 1, wherein said control means, connecting means, attaching means and suction means are located in a unitary housing.

3. The device according to claim 1, wherein said transfer means, prevention means and stopping means are formed into a single tube with a top and a bottom, and where said tube top is attached to said control means.

4. The chemical supply device according to claim 1, wherein said prevention means comprises a unidirectional flow valve for permitting fluid flow out of said storing means and preventing fluid flow into said storing means.

5. The chemical supply device according to claim 1, wherein said suction means comprises a venturi disposed in said suction conduit for creating a suction in said connecting conduit and said transfer means as a liquid from said liquid distribution system passes through said suction conduit.

6. The chemical supply device according to claim 1, wherein said control means comprises a valve means with an inlet connected to said transfer means and an outlet connected to said connecting means, said valve operative between first and second extreme positions, said first position permitting fluid flow and said second position preventing fluid flow, said valve means having a variable opening resembling the phases of the moon for controlling fluid flow between said first and second positions.

7. A liquid supply device for use with a liquid distribution system having a liquid distribution flow path comprising:

storing means for storing chemical supply;

a first substantially straight flow path for carrying chemicals from said storing means;

a second substantially straight flow path intersecting said first flow path at a predetermined angle for carrying chemicals from said first flow path to the liquid distribution flow path;

control means disposed in said first flow path for controlling liquid flow between said first and second flow paths;

prevention means in said first flow path for preventing liquid in the distribution system from flowing into said storing means; and stopping means for automatically stopping liquid flow from said storing means into said first flow path when chemical supply in said storing means reaches a predetermined level.

8. The chemical supply device according to claim 7, wherein said storing means comprises a closed container with a top and an opposed bottom, said closed container having an opening defined by a lid at said top of said container, said container defining a reservoir interior for holding a supply of liquid chemicals.

9. The chemical supply device according to claim 7, wherein said prevention means comprises a unidirectional flow valve for permitting fluid flow out of said storing means and preventing fluid flow into said storing means.

10. The liquid supply device of claim 7, further comprising:

transfer means attached to said storing means for transferring chemicals out of said storing means along said first flow path to said control means;

a unitary housing having therein a control conduit for receiving chemicals from said transfer means, and carrying said chemicals along said first flow path to said second flow path, a connecting conduit intersecting said control conduit for carrying chemicals along said second flow path, and a substantially straight suction conduit intersecting said connecting conduit forming a segment of said liquid distribution flow path to receive chemicals from said connecting conduit into said liquid distribution flow path; and suction means in said suction conduit for creating suction in said connecting conduit, control conduit and transfer means.

11. The device according to claim 10, wherein said transfer means, prevention means and stopping means are formed into a single tube with a top and a bottom, and where said tube top is attached to said control means.

12. The chemical supply device according to claim 10, wherein said suction means comprises a venturi disposed in said suction conduit for creating a suction in said connecting conduit and said transfer means as a liquid from said liquid distribution system passes through said suction conduit.

13. The chemical supply device according to claim 10, wherein said control means comprises a valve means with an inlet connected to said transfer means and an outlet connected to said connecting conduit, said valve operative between first and second extreme positions, said first position permitting fluid flow and said second position preventing fluid flow, said valve means having a variable opening resembling the phases of the moon for controlling fluid flow between said first and second positions.

14. A liquid supply device for use with a liquid distribution system comprising:

a storing means for storing chemical supply;

transfer means attached to said storing means for transferring chemicals out of said storing means;

a unitary housing having therein a straight control conduit for receiving chemicals from said transfer means, a straight connecting conduit intersecting said control conduit at a first predetermined angle for carrying chemicals from said control conduit to the liquid distribution system, and a straight suction conduit for transferring chemicals from said connecting conduit to said liquid distribution system intersecting said connecting conduit at a second predetermined angle;

control means attached to said housing and inserted into said control conduit for controlling liquid flow from said transfer means;

suction means in said suction conduit for creating suction in said connecting conduit, control conduit for transfer means;

prevention means in said transfer means for preventing liquid in the distribution system from flowing into said reservoir; and stopping means on said transfer means for automatically stopping liquid flow from said storing means into said transfer means when chemical supply in said storing means reaches a predetermined level.

15. The chemical supply device according to claim 14, wherein said control means comprises a valve means with an inlet connected to said transfer means and an outlet connected to said connecting conduit, said valve operative between first and second extreme positions, said first position permitting fluid flow and said second position preventing fluid flow, said valve means having a variable opening resembling the phases of the moon for controlling fluid flow between said first and second positions.

16. The device according to claim 14, wherein said transfer means, prevention means and stopping means are formed into a single tube with a top and a bottom, and where said tube top is attached to said control means.

17. The chemical supply device according to claim 14, wherein said storing means comprises a closed container with a top and an opposed bottom, said closed container having an opening defined by a lid at said top of said container, said container defining a reservoir interior for holding a supply of liquid chemicals.

18. The chemical supply device according to claim 14, wherein said prevention means comprises a unidirectional flow valve for permitting fluid flow out of said storing means and preventing fluid flow into said storing means.

19. The chemical supply device according to claim 14, wherein said suction means comprises a venturi disposed in said suction conduit for creating a suction in said connecting conduit and said transfer means as a liquid from said liquid distribution system passes through said suction conduit.

* * * * *